US005702285A

United States Patent [19]

Orlando

[11] Patent Number: 5,702,285

[45] Date of Patent: Dec. 30, 1997

[54] ONE CUP POST-CONVALESCENT BRASSIERE

[76] Inventor: Jacqueline Orlando, 1636 NW. 51st Ter., Gainesville, Fla. 32605

[21] Appl. No.: 672,085

[22] Filed: Jun. 27, 1996

[51] Int. Cl.[6] ..... A41C 3/00

[52] U.S. Cl. ..... 450/1; 450/41; 450/53; 2/73

[58] Field of Search ..... 450/30, 31, 32, 450/53, 54, 55, 56, 57, 58, 1, 39, 40; 2/102, 104, 105, 106

[56] References Cited

U.S. PATENT DOCUMENTS

| | | |
|---|---|---|
| 1,417,930 | 5/1922 | Mailleue . |
| 2,715,225 | 8/1955 | Gould . |
| 3,094,125 | 6/1963 | Lewis . |
| 3,401,407 | 9/1968 | Pittman . |
| 3,447,538 | 6/1969 | Keown . |
| 3,517,671 | 6/1970 | Freedman . |
| 3,568,681 | 3/1971 | Comollo . |
| 3,701,168 | 10/1972 | Balow . |
| 4,023,575 | 5/1977 | Nixon . |
| 4,166,471 | 9/1979 | Griffin et al. . |
| 4,185,332 | 1/1980 | Jahnig . |
| 4,261,366 | 4/1981 | Lamborn . |
| 4,369,792 | 1/1983 | Miller . |
| 4,637,398 | 1/1987 | Sherwood . |
| 4,699,144 | 10/1987 | Sherwood ..... 450/54 |
| 5,158,541 | 10/1992 | McCurley . |
| 5,257,956 | 11/1993 | Ewen ..... 450/58 X |
| 5,395,280 | 3/1995 | Greenberg . |

*Primary Examiner*—Jeanette E. Chapman
*Attorney, Agent, or Firm*—Holland & Knight LLP

[57] ABSTRACT

A garment for post-convalescent wear as a brassiere or bikini top by women who have undergone removal of a breast. The garment includes an uncupped panel which overlies the area of the chest wall from which the breast has been removed as well as an adjoining cup for receiving and supporting the remaining breast.

1 Claim, 2 Drawing Sheets

ONE CUP POST-CONVALESCENT BRASSIERE

FIELD OF THE INVENTION

The invention relates to garments for women. More particularly, the present invention relates to a single cupped garment useful for post-convalescent wear as a brassiere or a bikini top by women who have undergone removal of a breast.

BACKGROUND OF THE DISCLOSURE

The removal of a woman's breast can occur incident to physical trauma such as that suffered in an automobile collision or other serious accident. Removal of a breast may also be indicated in the course of medical treatment for pathological conditions such as tumors or breast cancer. Regardless of the circumstances, loss of a breast can engender adverse psychological consequences ranging from a relatively minor and temporary sense of insecurity and self-consciousness to a pronounced and enduring loss of self-esteem accompanied by feelings of inadequacy and inferiority. These psychological effects can have a more profound negative impact on a woman than the physical changes underlying them. The ability of a woman to relate effectively with her spouse, her family and persons in her workplace can be markedly impaired. Symptoms of depression are not uncommon.

Reconstructive surgery has been looked to as a primary mode of avoiding or treating the emotional problems which can accompany loss or removal of a breast. Surgery, however, always entails risks including the risk of infection and the risks associated with anesthesia. It is typically painful and always expensive. Sometimes multiple procedures are required, each entailing its own risks and necessary period of recovery during which the patient may be unable to work or subject to other restrictions on her activity. For all of those disadvantages, reconstructive surgery does not always produce results which are both medically and cosmetically acceptable. All too frequent are cases in which emotional and physical problems are exacerbated by reconstructive surgery which, even if medically successful, fails to fulfill the expectations and hopes of the patient for a complete and natural restoration.

Under circumstances where reconstructive surgery is not an available option or has been attempted with less than satisfactory results, the prior art has looked to various kinds of prosthetic devices and garments intended ostensibly for the purpose of restoring their wearer to her prior appearance. More directly stated, it has been the approach in the prior art to attempt to alter the appearance of a woman who has but one remaining breast in such a way that she would appear to others as though she were still possessed of two comparably sized and shaped breasts. For example, U.S. Pat. No. 1,417,930 describes a three-dimensional contoured bust substitute which is secured over the area of a removed breast by means of straps. A similar prosthesis having a bulbous portion suspended from a shoulder strap is described in U.S. Pat. No. 3,401,407 to Pitman which further teaches provision of an artificial nipple. Another approach has been to provide a brassiere-like garment having one ordinary cup and one cup provided with a pocket or other receptacle in which an appropriately sized and shaped breast form may be received or formed in-situ. Such garments are shown in a number of prior art patents including U.S. Pat. Nos. 3,447,538 to Keown; 3,517,671 to Freedman; 3,568,681 to Comallo; 3,701,168 to Balow; 4,699,144 to Sherwood; 4,166,471 to Griffen et al.; 4,023,575 to Nixon; 4,261,366 to Lamborn; 4,369,792 to Miller; 4,637,398 to Sherwood and 5,395,280 to Miller. U.S. Pat. No. 4,185,332 to Jahnig discloses a breast form holder which leaves the remaining breast unsupported and uncovered while providing a pocket for retaining a breast form over the area of the removed breast.

As the above-references demonstrate, the prior art reflects an unstated premise that once her physical convalescence has been completed, a woman who has lost a breast should modify her appearance so as to present herself to the outside world as having the "natural" and symetrical appearance described above. The present invention draws this premise into question by offering an alternative approach.

SUMMARY OF THE INVENTION

The present invention recognizes that the prior art has required a woman who has lost a breast to engage in a form of subterfuge to alter the profile of her body. It is believed that each time a woman uses one of these prior an devices she is receiving, and at least in some sense acknowledging, a message that her body in its present and true form is unacceptable to others and that she herself should not accept it. It is believed that this form of negative conditioning may, at least for some women, not only fail to aid in their psychological adjustment to the loss of a breast, but perhaps even have an opposite, harmful effect.

In view of the foregoing, it is a principal object of the invention to provide a garment for post-convalescent wear by women who have lost a breast which does not significantly alter the profile of her body and in so doing avoids giving rise to a negative inference of unacceptability.

It is a further object of the invention to satisfy the foregoing principal object by providing a garment which comfortably supports the remaining breast.

A further object of the invention is to fulfill the foregoing object while providing a panel which both comfortably conceals scar tissue from the area from which the breast was removed while lending an appearance similar to that of a conventional brassiere or bikini top.

These and other objects and advantages are realized by the present invention which takes the general form of a garment having an uncupped panel which overlies the area of the chest wall from which a breast has been removed as well as an adjoining cup for receiving and supporting the remaining breast. According to a preferred embodiment, the garment of the invention further includes a back strap and a pair of shoulder straps. One of the shoulder straps connects an upper portion of the cup to the back strap to support the remaining breast while the other back strap is connected to the upper portion of the panel thereby providing additional support while emulating the appearance of a conventional brassiere or bikini top.

These and other objects and advantages of the invention will become apparent to a person of ordinary skill in the art upon review of the following detailed description and the accompanying drawings in which like reference numerals designate like items.

DETAILED DESCRIPTION OF THE DRAWINGS

Figure 1:
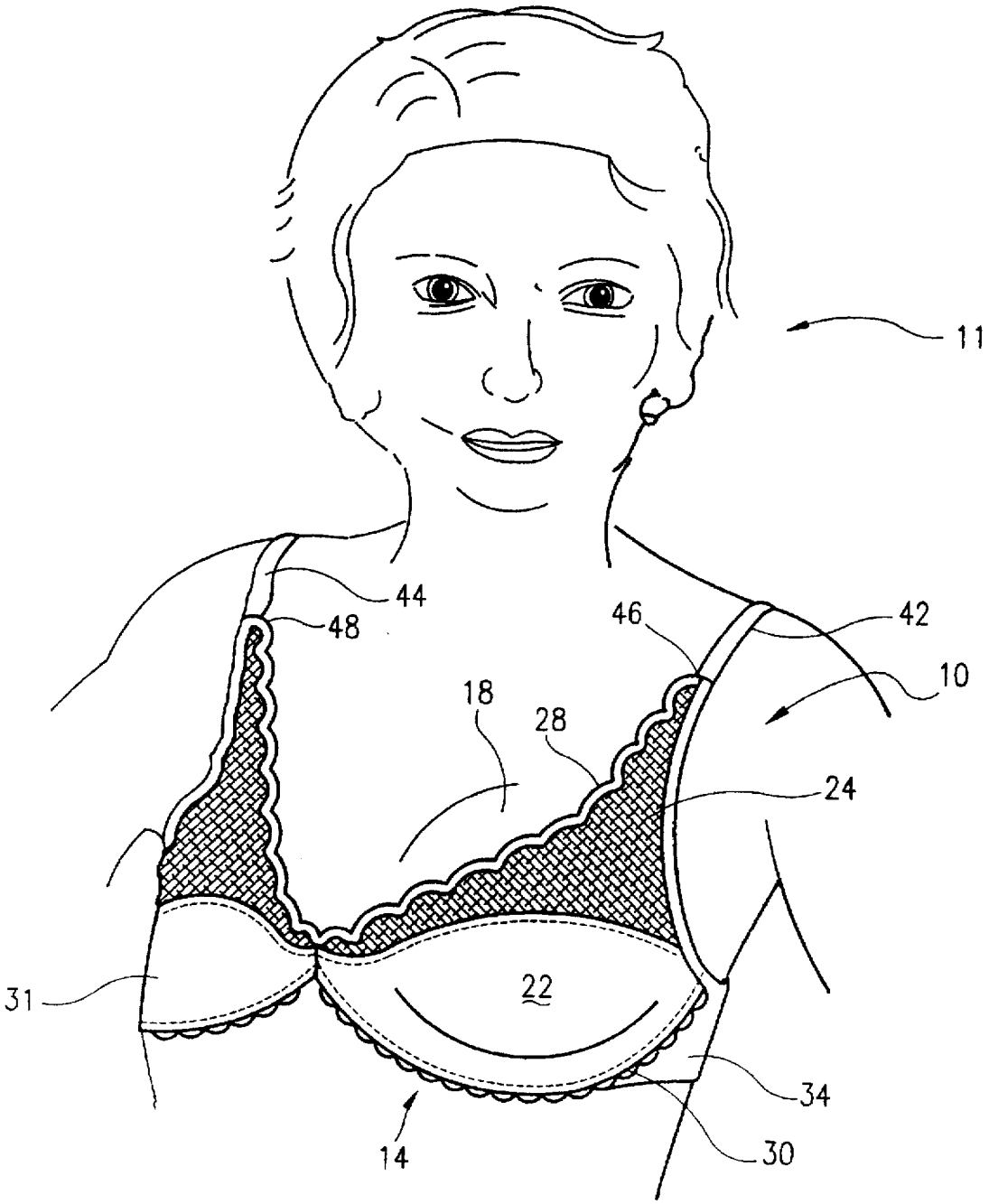
FIG. 1 is a partial frontal perspective view showing a woman wearing a preferred embodiment of a garment constructed according to the present invention as FIG. 2 is a partial rear perspective view corresponding to the frontal view of FIG. 1.
Figure 2:
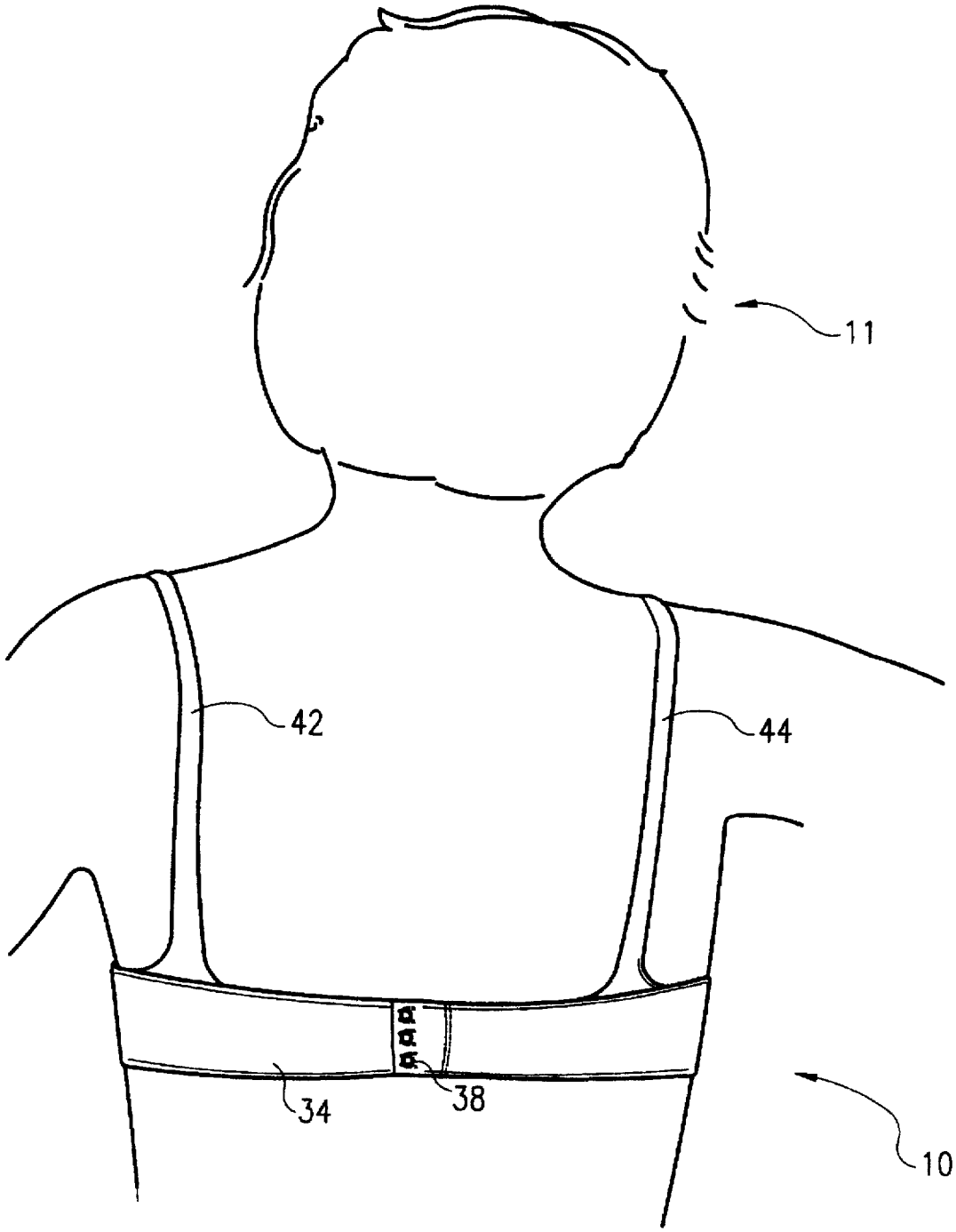

A preferred embodiment of a garment 10 constructed according to the present invention is shown in use by a wearer 11 in FIGS. 1 and 2. Garment 10 includes a generally convex shaped bra cup 14 of a size and shape for comfortably receiving and supporting the single remaining breast 18 of wearer 11. Cup 14 may take any conventional three dimensional convex form and construction. Cup 14 may suitably be padded or unpadded, lined or unlined, with or without underwire, and decorated as desired. For example, but not by way of limitation the cup 14 of the garment 10 of the preferred embodiment includes a fabric lower cup portion 22 and a generally triangularly shaped upper portion 24 of mesh or lace having an inside edge 28. Inside edge 28 may be plain or styled as desired such as with decorative scallops as shown in FIG. 1. Optionally, the lower edge of cup 14 may include a generally u-shaped support 30 or "underwire" of wire, plastic, bone or other conventional material to lend support to breast 18 and thus, comfort to wearer 11. When a support 30 is provided, it is preferably encased in a pocket formed in the lower seam of cup 14 so as to be concealed from view and padded for the comfort of wearer 11 in the manner conventional in the art.

According to an important aspect of the present invention, garment 10 includes a non-cupped panel 31 positioned juxtaposed cup 14 so as to at least partially overlie that area of the wall of the chest of wearer 11 from which her remaining breast had been removed. Lacking a traditional cupped shape, panel 31 is substantially flat so as to be capable of conforming to the exterior chest wall of wearer 11 without significant wrinkling or bunching.

Panel 30 is preferably of a size similar to cup 14 and is preferably constructed of the same exteriorly-facing fabrics as cup 14 so as to provide a matched visual appearance. Likewise, panel 31 is preferably of a shape the same as or similar to a frontal planar projection of the shape of cup 14 which, in the preferred embodiment illustrated, is a generally triangular shape as illustrated in FIG. 1. Panel 31 would not ordinarily be provided with an underwire or similar support but may optionally be lined with a relatively thin inner layer of soft padding material, such as brushed cotton or the like, to avoid chafing underlying scar tissue.

Panel 31 is connected at one corner either directly as shown or indirectly by way of an intermediate bridging member, such as a releasable clasp or a piece of fabric or other flexible material, to the portion of cup 14 which lies adjacent the sternum of wearer 11.

The opposing corner of panel 31 is connected to a flexible fabric back strap 34 which traverses the upper back of wearer 11 and is connected at its opposite end to a corresponding location on cup 14 as shown. Back strap 31 may be formed of or include a strip of elastic material to provide a comfortably snug fit to allow wearer 11 complete freedom of movement without binding or pinching. Such an elastic strip is shown for example in prior art U.S. Pat. No. 2,715,225 to Gould which is expressly incorporated herein by reference in its entirety to form part of the present disclosure. In the preferred embodiment as illustrated in FIG. 2 back strap 34 is formed in two sections joined by conventional hook-and-eye fasteners 38 as shown. Alternatively back strap 38 may be formed as a single, continuous member connecting corresponding locations on cup 14 and panel 31 with a releasable fastener instead being provided between cup 14 and panel 31 above the sternum of wearer 11. The use of a releasable fastener positioned between the cups of a brassiere is shown for example in U.S. Pat. No. 2,715,225 to Gould. Garment 10 is additionally provided with a pair of shoulder straps 42 and 44 which connect respectively to the apex 46 of cup 14 and the apex 48 of panel 31. If desired, shoulder straps 42 and 44 may be formed of or include segments of elastic material and conventional length adjustment buckles (not shown).

While the foregoing describes a preferred embodiment of the present invention it is to be understood that the invention is not limited to such an embodiment and that in light of the present disclosure, various alternative embodiments will be apparent to persons skilled in the art. Accordingly, it is to be recognized that changes can be made without departing from the scope of the invention as particularly pointed out and distinctly claimed in the appended claims including all legal equivalents.

What is claimed is:

1. A garment for post-convalescent wear by women who have undergone removal of a breast and have a single remaining breast, said garment comprising:

(a) a bra cup of a generally convex shape and size adapted for receiving said remaining breast, said bra cup being provided with a support member for lending support to said remaining breast;

(b) a non-cupped flat panel of flexible material mechanically coupled to said bra cup and positioned to overlie at least a portion of the area of the chest wall of the wearer from which the removed breast has been removed when said garment is worn;

(c) a back strap mechanically coupled to said panel and to said bra cup;

(d) a first shoulder strap non-detachably connecting said bra cup to said back strap; and (e) a second shoulder strap non-detachably connecting said panel to said back strap.

* * * * *